United States Patent [19]

Selon

[11] 4,106,221

[45] Aug. 15, 1978

[54] TWO-DIMENSIONAL VISUALIZATION AID FOR THE RETAIL JEWELRY TRADE

[76] Inventor: Michael David Selon, 301 Wisconsin, Oak Park, Ill. 60302

[21] Appl. No.: 765,092

[22] Filed: Feb. 2, 1977

[51] Int. Cl.[2] ..... B44F 1/06

[52] U.S. Cl. ..... 35/53; 35/27; 428/15; 428/202

[58] Field of Search ..... 35/24 R, 27, 28, 28.5, 35/53, 54, 60; 281/16, 39

[56] References Cited

U.S. PATENT DOCUMENTS

| | | | |
|---|---|---|---|
| 886,057 | 4/1908 | Hockaday | 35/53 |
| 1,070,891 | 8/1913 | Hochstetter | 35/27 UX |
| 2,294,131 | 8/1942 | Raymond | 35/53 |
| 3,011,271 | 12/1961 | Millspaugh | 35/53 |
| 3,406,467 | 10/1968 | Davis | 35/24 R |
| 3,565,462 | 2/1971 | Gottlieb | 35/50 X |
| 3,785,912 | 1/1974 | Van Deusen | 35/27 X |

*Primary Examiner*—Harland S. Skogquist

[57] ABSTRACT

An apparatus for aiding the retail jewelry customers' visualization of what their previously owned and/or newly purchased diamonds (and/or colored faceted stones) will look like when set into a new blank jewelry setting, attaining a complete piece of new jewelry. This practice of resetting to modernize a customer's gems is a growing facet of the jewelry industry and is referred to as remounting. The apparatus consists of a catalog of blank jewelry settings, a frame for isolating one setting picture at a time and two hundred permanently silk-screen printed Mylar cards each with a two color representation of a different size diamond and/or shape of diamond or arrangement of diamonds, all held together in a three-part heat sealed folder.

The object of the invention is to manipulate those cards corresponding to the customer's previously owned and/or newly purchased diamonds (and/or colored faceted stones) over the catalog picture under the frame thereby providing the customer with a two dimensional visualized preview of what their previously owned and/or newly purchased diamonds (and/or colored faceted stones) will look like when remounted.

The invention is easy to use by anyone working in the field, and is versatile in its applications and ability to represent quickly and neatly suggested stone layouts on jewelry thusly aiding the sales potential of any retail jewelry store.

3 Claims, 2 Drawing Figures

TWO-DIMENSIONAL VISUALIZATION AID FOR THE RETAIL JEWELRY TRADE

FIELD OF THE INVENTION

The present invention relates to a visualization aid for the purpose of allowing a retail customer the ability to quickly and easily see what their previously owned and/or newly purchased diamonds (and/or colored faceted stones) will look like when set into a blank (without gems/before setting) piece of jewelry of the customer's choice, before any actual jewelry work and/or gem setting is performed, thus allowing a merchandising advantage to the retail jeweler.

BACKGROUND OF THE INVENTION

The revitalization of a retail customer's presently owned precious gems (diamonds, rubies, emeralds, etc.) as part of old jewelry by re-setting them into more modern blank settings is an ever growing facet of the jewelry trade and is hereafter referred to as "remounting". At present it is common for the retail jeweler, in order to promote a sale, to either draw pictures of what the retail customer's previously owned and/or newly purchased diamonds (and/or colored faceted stones) will look like when re-set into a blank setting of the customer's choice; or to show the retail customer an already set piece of jewelry that is similar or identical; or to ask the customer to imagine what their previously owned and/or newly purchased diamonds (and/or colored faceted stones) will look like as a finished set piece of jewelry after the jewelry work and/or gem setting has been performed.

Another observed method of allowing the retail customer the advantage of seeing what their previously owned and/or newly purchased diamonds (and/or colored faceted stones) will look like when remounted is a system of two-dimensional representations of gems as transfers which are rubbed onto a blank sheet of paper or a 1:1 picture of blank mountings such as found in a catalog. This method being disadvantaged by the fact that these transfer images are permanent and end the subsequent use of any catalogs used for this purpose.

OBJECTS OF THE INVENTION

It is therefore an object of the present invention to give the retail jeweler an improved means of providing the retail customer the advantage of seeing what the customer's previously owned and/or newly purchased diamonds (and/or colored faceted stones) will look like as a finished set piece of jewelry before the required jewelry work and/or gem setting is actually performed.

Another object of this invention is the provision of a method for allowing the retail customers to see what their previously owned and/or newly purchased diamonds (and/or colored faceted stones) will look like as a finished piece of jewelry before the required jewelry and/or gem setting is actually performed that is versatile and does not destroy any two dimensional catalog representation in the process.

Yet another object is the provision of such a "previewing" method that requires no artistic drawing abilities of the user and which can be used readily by unskilled personnel or the customer themself.

SUMMARY OF THE INVENTION

These objects are attained according to the present invention in a visualization/merchandising aid for the purpose of allowing a retail customer to preview what their previously owned and/or newly purchased diamonds (and/or colored faceted stones) will look like when set into a blank jewelry setting of the customer's choice and consists mainly of two hundred separate transparent Mylar overlay cards, two color (black and white) silkscreen process printed with two dimensional images of various sizes and shapes of diamonds and arrangements of diamonds which might be used in manufacturing finished set jewelry. These two hundred separate transparent gem cards each with a different size and/or shape of diamond or arrangement of diamonds are held in nine different pockets of transparent vinyl heat sealed on the middle panel of a three-part folder produced in the electronic heat sealing method. Each vinyl pocket has silkscreen printed on it the category of diamonds or arrangement of diamonds represented on the transparent mylar cards held within. Each transparent card in addition to the two dimensional image of the diamond has a silkscreen printed description of the diamond or arrangement of diamonds printed on that card and a small black dot in any one of nine positions across the top of the card relating directly to which of the nine pockets that particular card belongs. There are from 19 to 24 such separate transparent Mylar cards in each of the nine pockets. These dots and the printed description of each diamond or arrangment of diamonds is for the purpose of keeping the two hundred transparent cards in order during and after use of the invention.

In addition to the two hundred overlay cards a catalog of ring and pendant settings is provided in the left hand panel of the three-part folder under its own transparent vinyl pocket and on the right hand panel of the three-part folder all under three opaque vinyl pockets are provided; offset printed sheet of instructions on the applied uses of the invention, a sheet of retail labor prices for the necessary jewelry work and/or gem setting when performed by the applying company, and a sheet of five discount coupons which may be redeemed by the retail jeweler when ordering materials from the applying company; in the second smaller pocket, order and instruction forms designed for use with the invention and eight sheets of tracing paper as an integral part of the ordering process; a third yet smaller pocket holds a blank vinyl "frame" with a square hole die struck from the center for the purpose of isolating each setting of the retail customer's choice in turn as the invention is put to use.

The invention is put to use by removing those Mylar overlay cards, corresponding to the diamonds and/or colored faceted gemstones the retail customer wishes to have remounted from the pockets and set them aside on the sales counter. Next, the retail jeweler and the customer go through the catalog and note which blank settings may look appealing to the customer utilizing the customer's gems to be remounted. At this point the retail jeweler removes the frame from its pocket and places it over one of the pictures so as to isolate it from the others on the page for the viewing advantage of the customer. Then, the separate Mylar cards are placed under the frame and manipulated by the outer edges until an amiable arrangement of the gems on the blank mounting is achieved. According to a feature of the invention the "gem card overlays" may be immediately moved to other positions on the same catalog picture to suite the customer tastes without any damage having been done to the catalog picture of the blank mounting.

Should the retail customer not like any of the suggested gem layouts as presented to him/her the jeweler may then pick up the gem cards and the frame and repeat the overlaying process on any or all of the blank mounting noted earlier in the sales encounter. When the final gem layout has been determined by the retail customer on the blank setting of their choice, the jeweler them carefully removes the frame leaving the gem layout intact and places a piece of the tracing paper over the gem cards and traces the outline of the ring and the placement position of the gems on the blank setting. Next, referring to the printed description of each gem card used and the catalog number of the blank setting used the retail jeweler appropriately labels each outline representing each gem. This tracing is attached to the order form provided and sent to the applying company for the necessary jewelry work and/or gem setting to complete the job.

According to yet another feature of the invention the retail jeweler may color the silkscreen printed two dimensional gem on the Mylar overlay card with water-soluble felt tip markers to simulate the use of colored faceted gems (rubies, sapphires, emeralds, etc.) in the design of the jewelry layout. When the sales presentation is completed the jeweler may easily wash off any color tint leaving a clean black and white permanently printed two dimensional image of the diamond or arrangement of diamonds.

According to another feature of the invention the retail jeweler may at any time suggest to the customer that the addition of a few selected sizes and/or shapes of diamonds might enhance the beauty of the customer's new piece of jewelry when finished by removing the suggested gems from the pockets and adding them to the design being previewed. Also, if the retail jeweler has the blank mounting of the customer's choice on hand, the retail jeweler might place the two dimensional representation of the gem directly over the three dimensional blank mounting to give the customer the idea of the size relationships between the gem and the blank mounting.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
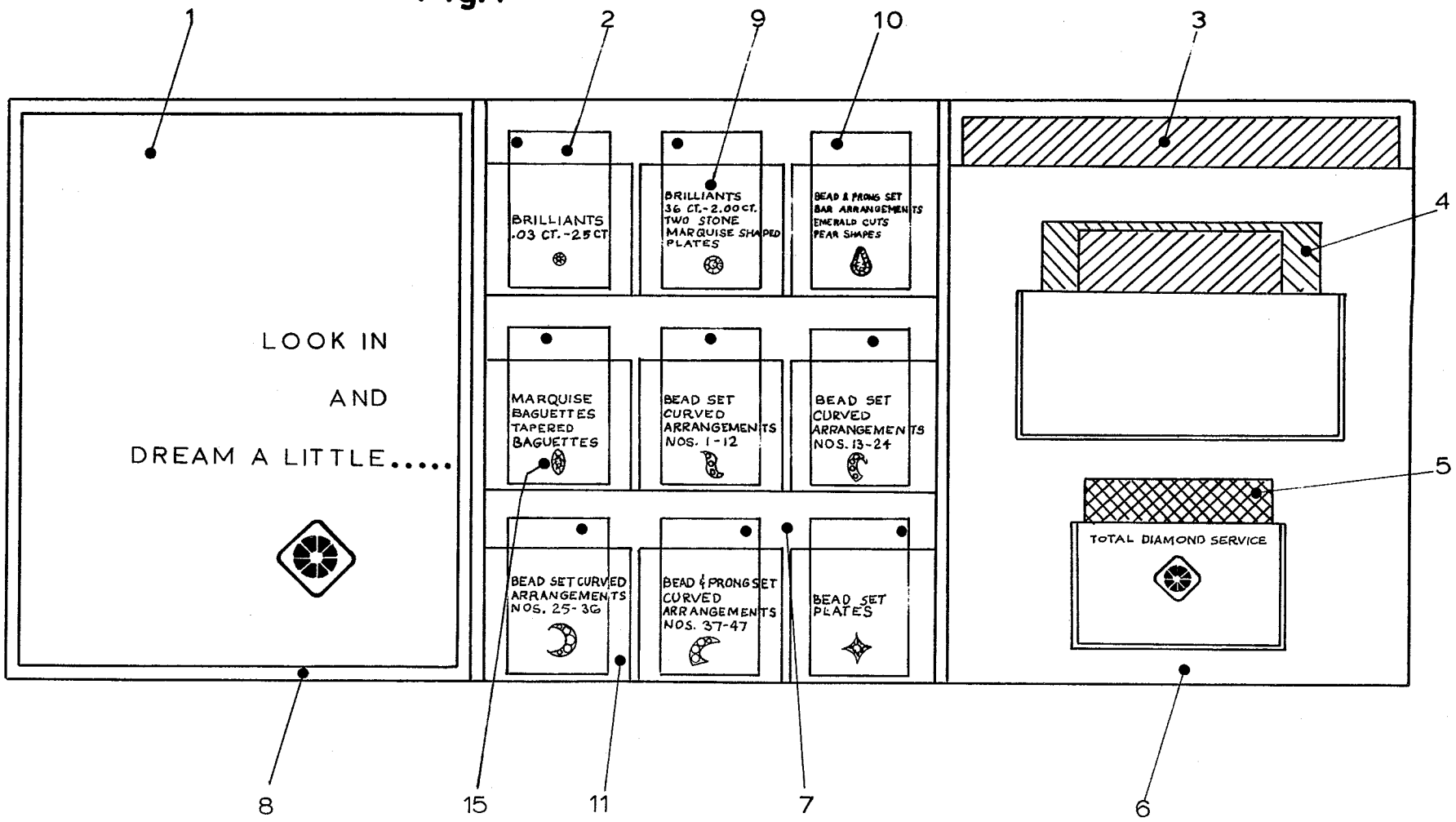
FIG. 1 is a full view of the invention in the form of a three-part folder opened up so as to expose the components on all three panels.

The arrangement shown in FIG. 1 represents the complete workable components of the invention as housed in their three-part folder 6, 7, 8 here opened so as to expose the inside of all three panels. The left hand panel 8 housing under a transparent pouch opening to the right a catalog 1 of blank jewelry settings litho and offset printed. It should be noted that this catalog provided with the invention may be sutstituted with any other catalog of the jewelry industry that pictures blank jewelry settings at full scale so as to match the scale of the two dimensional representations of diamonds or arrangements of diamonds 15. The center panel 7 has three horizontal rows of transparent vinyl pockets opened to the top, each horizontal row being divided into three individual pockets 11 for a total of nine individual transparent vinyl pockets. These pockets as the rest of the folder are electronically heat sealed vinyl over 4mm chipboard stock. Within these nine individual transparent vinyl pockets are placed nine groups of transparent Mylar "gem card overlays" 2, from 19 to 24 Mylar cards per pocket for a sum of two hundred separate transparent Mylar "gem card overlays" 2. Permanently silkscreen printed in white on the face of each of the nine individual transparent vinyl pockets is the heading(s) 9 stating which of the two hundred gem cards 2 belong in each respective pocket (e.g. brilliant cut diamonds from 0.36 carats and marquise shaped white gold plates each set with two diamonds).

Figure 2:
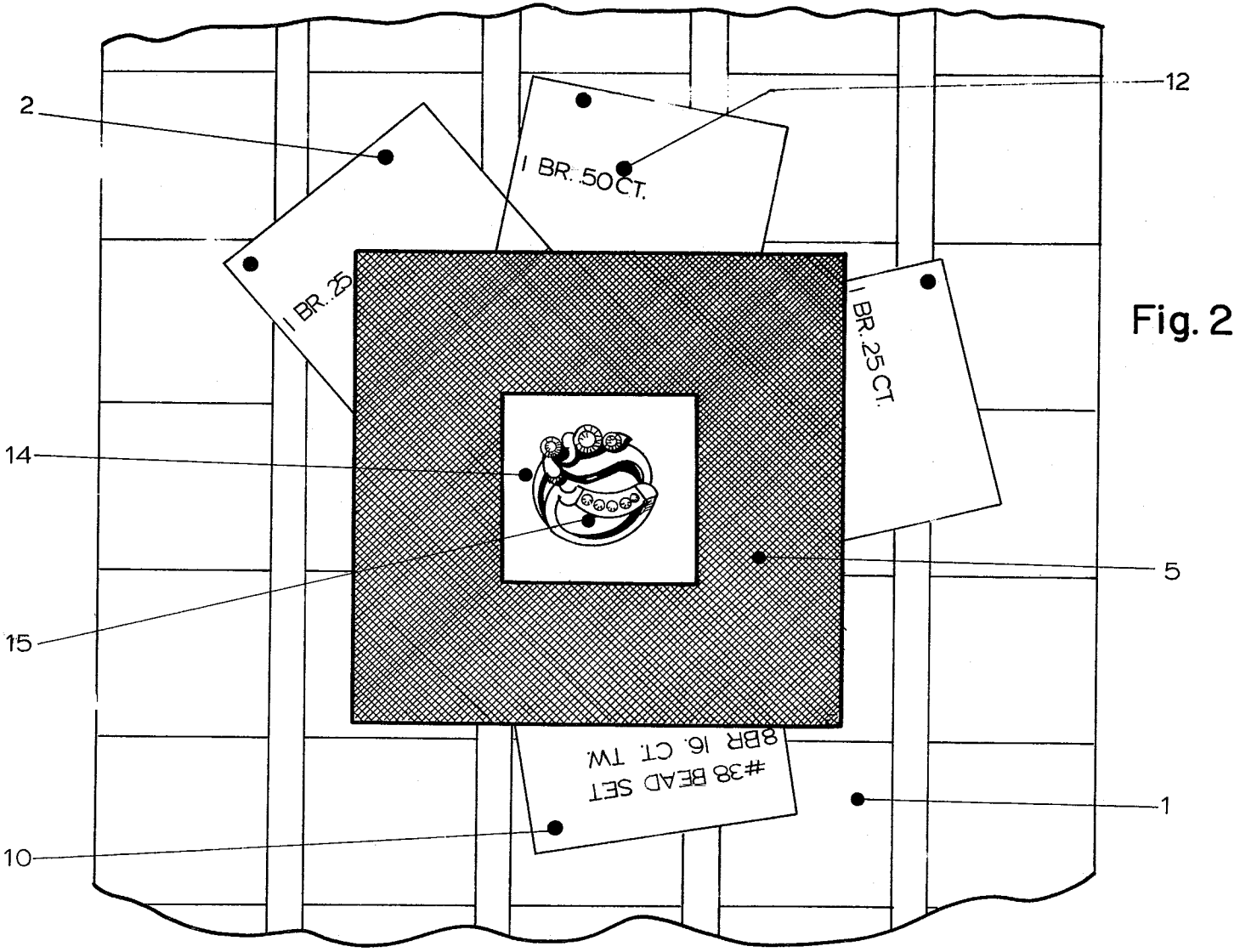
FIG. 2 is a detail of the invention in use showing the viewing frame, overlay gem cards placed over a typical catalog picture presenting a two dimensional representation of the finished set piece of jewelry.

The arrangement shown in FIG. 2 depicting the invention in use shows the individual Mylar gem cards 2 in place showing an arrangement of diamonds over the catalog picture 14 of a blank jewelry setting. A small dot 10 is permanently silkscreen printed in black at the top of each of the individual mylar gem cards 2 in any one of nine positions laterally determined by which of the nine individual transparent vinyl pockets each card 2, along with the others in the subgroup, belongs (e.g. all of the cards 2 that depict bead set plates have a black dot in the ninth position across the top relating them to the ninth pocket on the middle panel 7 counting horizontally from left to right and down). The dot 10 and the printed description on each individual gem card 2 is for the purpose of keeping the two hundred gem cards in their proper place during and after use of the invention.

The right-hand panel 6 of the three-part folder is composed of three opaque vinyl pockets into which instructions for use to the retail jeweler and a retail labor price list and discount coupons 3 all offset printed, are inserted in the top and largest pocket. Inserted into the middle pocket are eight pieces of tracing paper and four order forms 4 for specific use with the invention. In the lower, smallest pocket is inserted the black rigid vinyl viewing frame 5 used in the operation of the invention.

The invention is operated as follows: At the beginning of the sales encounter, the retail jeweler places the closed up folder on the counter or desk and opens it up so as to expose the inner side of all three panels 6, 7, and 8. Taking the retail customer's old jewelry containing those previously owned and/or newly purchased diamonds (and/or colored faceted stones) to be remounted the jeweler refers to the printed titles 9 on the nine transparent vinyl pockets 11 and removes those individual gem cards 2 which match those previously owned and/or newly purchased diamonds (and/or colored faceted stones) to be remounted in the more modern settings pictured in the catalog 1. Having set aside those individual cards 2 on the counter, the retail jeweler may return the old jewelry to the customer and remove the catalog of blank jewelry settings 1 from its transparent vinyl pocket situated on the left hand panel 8. At this point, the retail jeweler guides the customer through the pages of the catalog 1 noting those blank settings that appeal to the customer and which at the same time could be set with the customer previously owned and/or newly purchased diamonds (and/or colored faceted stones). After a number of blank settings have been noted, the retail jeweler removes the black vinyl frame 5 from its pocket on the right hand panel 6 and places the frame on the catalog page so as to isolate a blank setting of the customer's choice within the hole in the frame 5. The retail jeweler then slides each Mylar gem card overlay 2 into place in a likeable position over the catalog picture 14 and under the frame 5. This is done with each card until the images of the gems to be remounted have been situated in an agreeable layout on the picture of the blank setting of the customer's choice. At this point, should the customer wish to preview what their previously owned and/or newly purchased diamonds (and/or colored faceted stones) might look like set into another blank jewelry setting, the retail jeweler or the retail customer may pick-up the frame 5 and gem cards 2 and repeat the layout procedure on subsequent pictures as noted earlier.

According to another feature of the invention, should the retail customer possess any colored faceted gems to be remounted, the retail jeweler may simulate these by tinting the permanently printed silkscreen images on the gem cards 2 with the use of common water soluble felt tip markers (e.g. red for rubies, green for emeralds, blue for sapphires, etc.). When the retail jeweler has completed the presentation to the customer the water soluble tints may be completely removed with water with no harm done to the permanently printed silkscreen images of the gem cards 2.

A further advantageous feature of the invention is its use in promoting the sale of additional gems to the customer by the jeweler. This is accomplished as follows: At the time the jeweler is performing the layout of the gem images 15 over the catalog picture 14 a suggestion may be brought up of how the addition of a few more gems might enhance and/or balance out the design. Those suggested additional gems are then brought forth from their respective pockets on middle panel 7 and slid into place over the catalog picture 14 under the frame 5 along with the gem images 15 of the customer's previously owned gems. The invention also works equally well in the case of original custom designs. In that case the retail jeweler first guides the customer through the pages of the catalog and then removes those stones that might be used in the designs from the individual vinyl transparent pockets 11 and proceeds with the layout procedure as described above.

Another feature of the invention allows the retail jeweler the chance to have the necessary jewelry work and/or gem setting to be completed by the applying company. For this purpose the tracing paper and order forms 4 are provided in the middle pocket of the right hand panel 6. The ordering procedure is as follows: Once the retail jeweler and customer have attained, by means of manipulating the gem cards 2 on the catalog pictures of the blank setting 14 under the black frame 5 as described above, a design that is to the liking of the customer, the retail jeweler should remove one piece of the tracing paper 4 from its pocket on the right hand panel 6 and place it over the attained layout of gem cards and catalog picture so as not to upset the order of same. With a commen pencil the retail jeweler then traces the outline of the specifically placed gem images 15 of the gem cards 2 and the outline of the blank jewelry setting. This need be done only so accurate so as to effectively communicate the correct gem placement on the selected setting and requires no artistic skills. In addition to the pencil outlines the specific printed information of each gem card 2 used and the style number of the specific setting 14 need be recorded on the tracing paper linked to the respective outlines with a simple line to indicate same. Then, this tracing should accompany the written order form 4 to be completed by the retail jeweler and mailed to the applying company for any and all necessary jewelry work and/or gem setting. When the sale encounter has been completed and the order form filled out the retail jeweler should place each of the two hundred separate mylar gem card overlays 2 in the appropriate individual transparent vinyl pockets 11 making use of the small black dot 10 printed across the top of each card. The catalog and frame 5 should be slipped away into their respective pockets on the left and right hand panels 8 and 6 of the three-part folder. The folder should then be folded back together and replaced near the sales counter for subsequent uses with future customers.

The invention in the form of a three-part folder with contents when closed measures 30.5 cm × 24 cm; each panel 6, 7, 8 measures 30.5 cm × 24 cm; total size when open so as to expose all three panels is 72 cm × 30.5 cm; catalog of blank jewelry settings 1 when closed is 28.1 cm × 21.8 cm; each individual mylar gem card 2 is 9.3 cm × 5.1 cm × 0.18 mm; each individual transparent vinyl pocket 11 is 7.2 cm × 7.8 cm; each of the silkscreened black dots is 0.35 cm diameter; the instructions for use, retail price list and sheet of discount coupons is 27.9 cm × 21.6 cm; the tracing paper measures 10.9 cm × 9.6 cm, and the order forms 4 measure 11 cm × 14 cm; the black vinyl viewing frame 5 measures 9.5 cm × 9.5 cm with a hole 3.8 cm × 3.8 cm die cut out of the center.

I claim:

1. Apparatus for aiding the two dimensional visualization of what a jewelry customer's faceted stones will look like as a finished piece of jewelry comprising: a three-part electronically heat sealed folder housing a large number of separate transparent Mylar cards with different two-color permanently printed two dimensional images of different sizes, shapes, and arrangements of the stones; a two color lithographed and offset printed catalog of different blank jewelry settings; a black vinyl square viewing frame; wherein a selection of the large number of separate Mylar cards are manipulatable over the individual pictures of blank jewelry settings, isolated by the black frame, so as to present a two dimensional image to a retail customer of what their faceted stones will look like as a finished piece of jewelry.

2. Apparatus as in claim 1, further including a collection of ordering materials, instructions, price list and redeemable discount coupons.

3. Apparatus as in claim 1, wherein the large number is 200.

* * * * *